US008939663B2

(12) United States Patent
Deonarine

(10) Patent No.: US 8,939,663 B2
(45) Date of Patent: Jan. 27, 2015

(54) RIBBON TENSION CONTROL SYSTEM AND METHOD FOR A RIBBON PRINTING SYSTEM

(71) Applicant: Illinois Tool Works Inc., Glenview, IL (US)

(72) Inventor: Indarjit Deonarine, Schaumburg, IL (US)

(73) Assignee: Illinois Tool Works Inc., Glenview, IL (US)

( * ) Notice: Subject to any disclaimer, the term of this patent is extended or adjusted under 35 U.S.C. 154(b) by 13 days.

(21) Appl. No.: 13/755,490

(22) Filed: Jan. 31, 2013

(65) Prior Publication Data

US 2014/0212196 A1 Jul. 31, 2014

(51) Int. Cl.
*B41J 33/52* (2006.01)
*B41J 33/14* (2006.01)
*B41J 35/08* (2006.01)

(52) U.S. Cl.
CPC . *B41J 33/14* (2013.01); *B41J 35/08* (2013.01)
USPC ..... 400/234; 400/236; 242/334; 242/421.4

(58) Field of Classification Search
USPC ..... 400/234
See application file for complete search history.

(56) References Cited

U.S. PATENT DOCUMENTS

| | | | | |
|---|---|---|---|---|
| 2,643,827 | A * | 6/1953 | Franzmann | 242/413.4 |
| 2,983,463 | A * | 5/1961 | Aaron et al. | 242/421.4 |
| 3,243,137 | A | 3/1966 | Norman | |
| 4,026,492 | A | 5/1977 | Kern | |
| 4,146,190 | A * | 3/1979 | Bond et al. | 242/413.5 |
| 5,857,786 | A * | 1/1999 | Randolph | 400/234 |
| 5,873,662 | A | 2/1999 | Clevinger | |
| 6,307,583 | B1 | 10/2001 | Randolph et al. | |
| 2005/0105950 | A1 * | 5/2005 | Ullenius et al. | 400/234 |

OTHER PUBLICATIONS

ISR and W/O for PCT/US2014/013222 dated Apr. 28, 2014 (9 pgs.).

* cited by examiner

*Primary Examiner* — Jill Culler
(74) *Attorney, Agent, or Firm* — Christopher R. Carroll; The Small Patent Law Group LLC

(57) ABSTRACT

A ribbon tension control system for a printing system includes a ribbon tension control apparatus. The ribbon tension control apparatus is configured to engage a print ribbon that extends through the printing system for applying one or more inks in the print ribbon to one or more target objects as the print ribbon is pulled from an unwind spindle to a windup spindle in the printing system. The ribbon tension control apparatus also is configured to control tension in the ribbon in response to change in a torque applied to the windup spindle that is used to pull the ribbon through the printing system.

14 Claims, 5 Drawing Sheets

RIBBON TENSION CONTROL SYSTEM AND METHOD FOR A RIBBON PRINTING SYSTEM

BACKGROUND

A variety of printing systems can apply or print images (e.g., graphics, text, or the like) on exterior surfaces of objects. Many of these systems directly engage or contact the exterior surfaces on which the images are printed. For example, a thermal transfer printing process can involve a print ribbon having ink that is transferred onto a target object by applying heat and pressure to the print ribbon as the print ribbon engages the target object. The print ribbon may be provided from a first spindle, where the print ribbon extends through one or more rollers to cause the ribbon to be disposed between a thermal print head and the target object. The first spindle now uses a friction brake in the form of a cord. It could also be a motor driven at low power, or one that is connected to a regenerative circuit. From this location, the print ribbon may extend through one or more other rollers to a second spindle. The second spindle may apply a torque to cause the print ribbon to unwind from the first spindle and move between the thermal print head and the target object, as well as move relative to the thermal print head and the target object, as the thermal print head applies heat and pressure to transfer ink from the print ribbon onto the target object.

The print ribbon is initially wound up on the first spindle such that the wound up print ribbon has an outer diameter. As the print ribbon is unwound from the first spindle, this outer diameter decreases. Changes in this outer diameter can result in changes in the tension in the print ribbon as the print ribbon moves between the thermal print head and the target object. Additionally, in some instances, the second spindle may apply a torque that is intermittent rather than continuous. For example, the torque applied by the second spindle to pull the print ribbon through the printing system may not be constant with respect to time. As a result, the tension in the print ribbon can change. If the tension changes too rapidly, the first spindle from which the print ribbon is taken may continue to spin somewhat uncontrollably such that the print ribbon continues to unwind from the first spindle even through the second spindle is no longer applying torque to the print ribbon.

These changes in the tension in the print ribbon can cause problems with transferring the ink from the print ribbon to the target object. For example, the images printed from the print ribbon can become blurry or incomplete.

BRIEF SUMMARY

In one embodiment, a ribbon tension control system for a printing system includes a ribbon tension control apparatus. The ribbon tension control apparatus is configured to engage a print ribbon that extends through the printing system for applying one or more inks in the print ribbon to one or more target objects as the print ribbon is pulled from an unwind spindle to a windup spindle in the printing system. The ribbon tension control apparatus also is configured to control tension in the ribbon in response to change in a torque applied to the windup spindle or a ribbon feed system.

In one embodiment, a method for controlling tension in a print ribbon of a printing system includes winding the print ribbon from an unwind spindle to a windup spindle. The print ribbon at least partially passes through a ribbon tension control apparatus. The method also includes pulling the print ribbon through the printing system from the unwind spindle to the windup spindle by applying a torque from the windup spindle. The print ribbon is pulled between a print head and one or more target objects to be printed upon by ink in the print ribbon when the print head engages the print ribbon. The method further includes controlling the tension in the print ribbon as the torque applied by the windup spindle changes by at least one of changing a path that the print ribbon follows through the printing system or varying a braking force applied to the unwind spindle.

In one embodiment, a tension control system of a thermal ribbon printing system includes a cam lobe, a dancer roller, a tension control member, an articulating arm, and a brake. The cam lobe is pivotally mounted in the thermal ribbon printing system. The dancer roller is coupled with the cam lobe. The tension control member is anchored in the thermal ribbon printing system and is coupled with at least one of the cam lobe or the dancer roller. The articulating arm is pivotally mounted in the thermal ribbon printing system and engages the cam lobe. The brake is coupled with the articulating arm and is configured to engage at least one of an unwind spindle or a flange coupled to the unwind spindle of the thermal ribbon printing system to apply a braking force to the unwind spindle. A thermal print ribbon extends from the unwind spindle, at least partially around the dancer roller, between a thermal print head and one or more target objects to be printed upon by the ribbon, and to a windup spindle. When the windup spindle applies a time-varying force to pull the ribbon through the thermal ribbon printing system, the cam lobe pivots to permit the dancer roller to laterally move in the thermal ribbon printing system and the tension control member applies an opposing force to resist the dancer roller laterally moving. Pivoting of the cam lobe causes the articulating arm to pivot, which changes a pulling force applied to the brake in order to vary the braking force.

BRIEF DESCRIPTION OF THE DRAWINGS

Reference is now made briefly to the accompanying drawings, in which.

DETAILED DESCRIPTION

Figure 1:
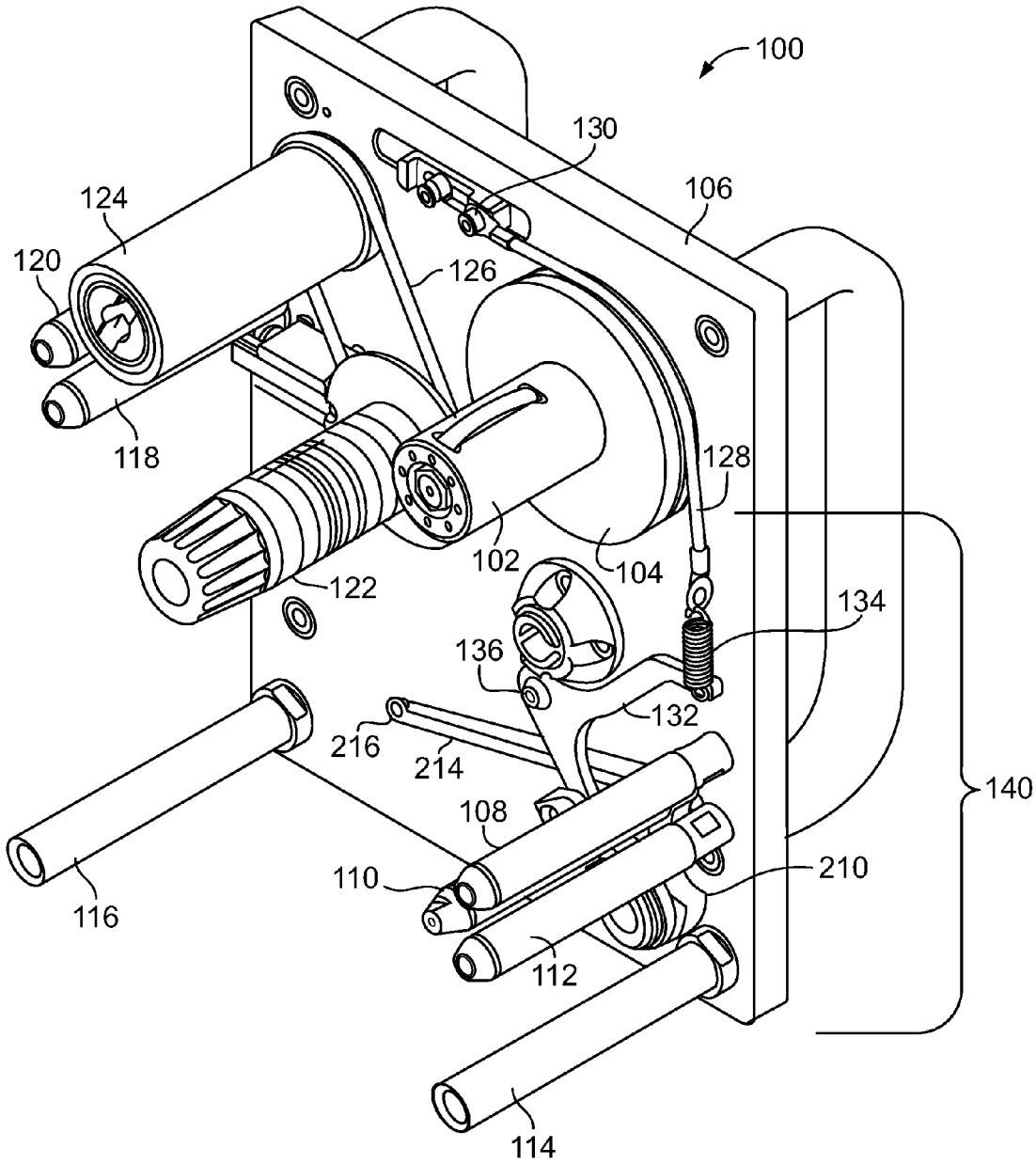
FIG. 1 is a perspective view of one embodiment of a printing system.

FIG. 1 is a perspective view of one embodiment of a printing system 100. The illustrated printing system 100 is a thermal printing system that prints images on exterior surfaces of target objects by applying heat and pressure to a print ribbon that includes ink. This heat and pressure transfers the ink from the print ribbon onto the target objects. The print ribbon is provided from an unwind or supply spindle 102. The unwind spindle 102 is coupled to a flange 104 that is rotatably coupled to a support plate 106 of the system 100. The unwind spindle 102 and the flange 104 rotate relative to the support bracket 106. The print ribbon is wound around the unwind spindle 102 such that the print ribbon can be pulled off of and away from the unwind spindle 102. As the print ribbon is pulled, the unwind spindle 102 and flange 104 rotate relative to the support bracket 106.

As described below, the print ribbon is pulled from the unwind spindle 102 and at least partially winds around several rollers 108, 110, 112, 114 before passing between a thermal print head and a target object. The number and arrangement of the rollers 108, 110, 112, 114 is not limiting on all embodiments of the inventive subject matter described herein. The thermal print head applies heat and pressure to the print ribbon to transfer ink to the target object. The print ribbon then is pulled at least partially around several additional rollers 116, 118, 120 before being wound up on a windup spindle 122. Although not shown in FIG. 1, the thermal print head is disposed between the rollers 114, 116 along a path defined by the print ribbon from the roller 112 to the roller 114. A motorized feed roller 124 is coupled with the windup spindle 122, such as by a belt or other component (e.g., reference 126). The motorized feed roller 124 applies a torque to the windup spindle 122 to cause the windup spindle 122 to pull the print ribbon from the unwind spindle 102, along the rollers, between the thermal print head and the target object, along additional rollers, and onto the windup spindle 122.

Figure 2:
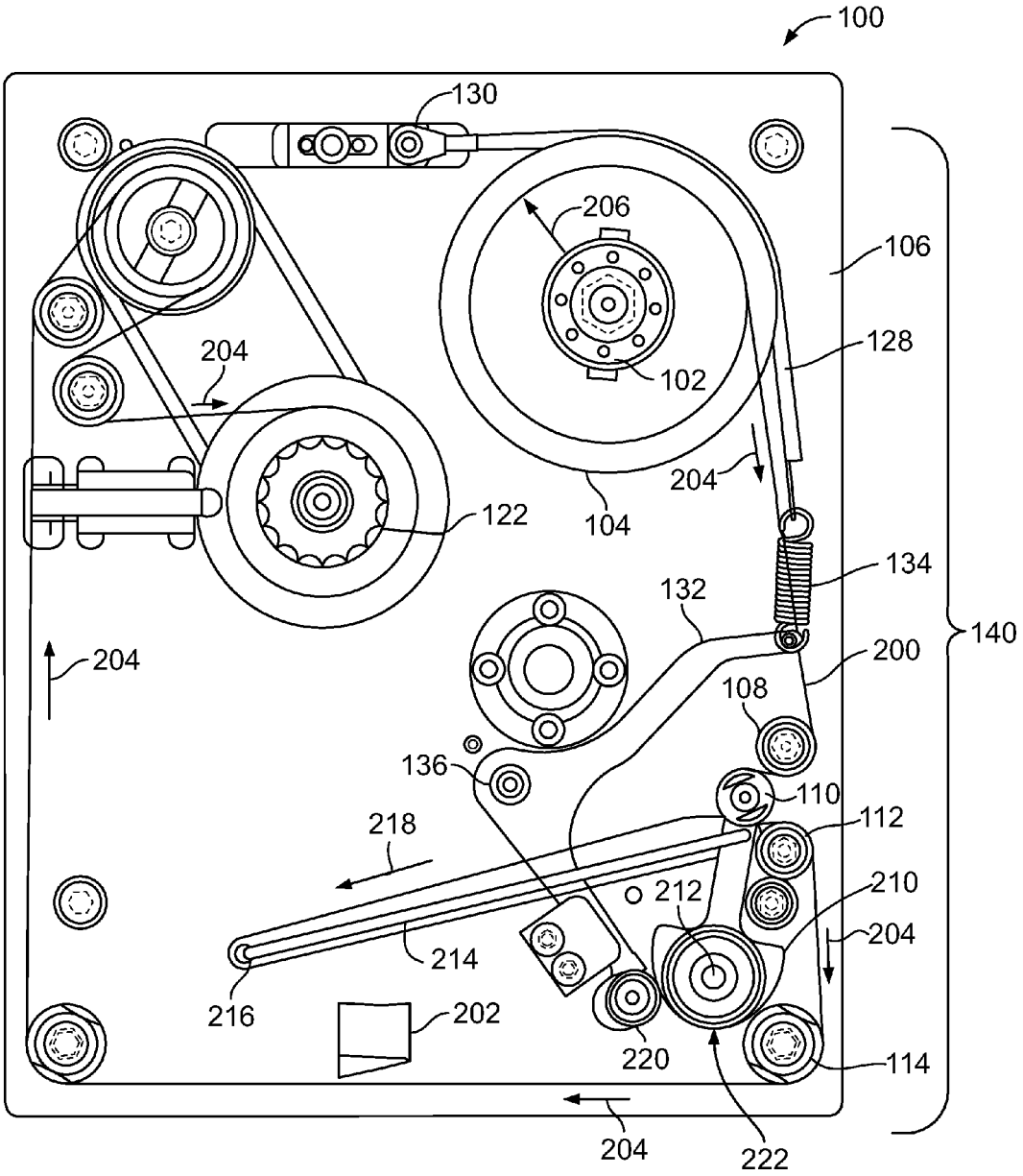
FIG. 2 illustrates a front view of the printing system shown in FIG. 1.
Figure 3:
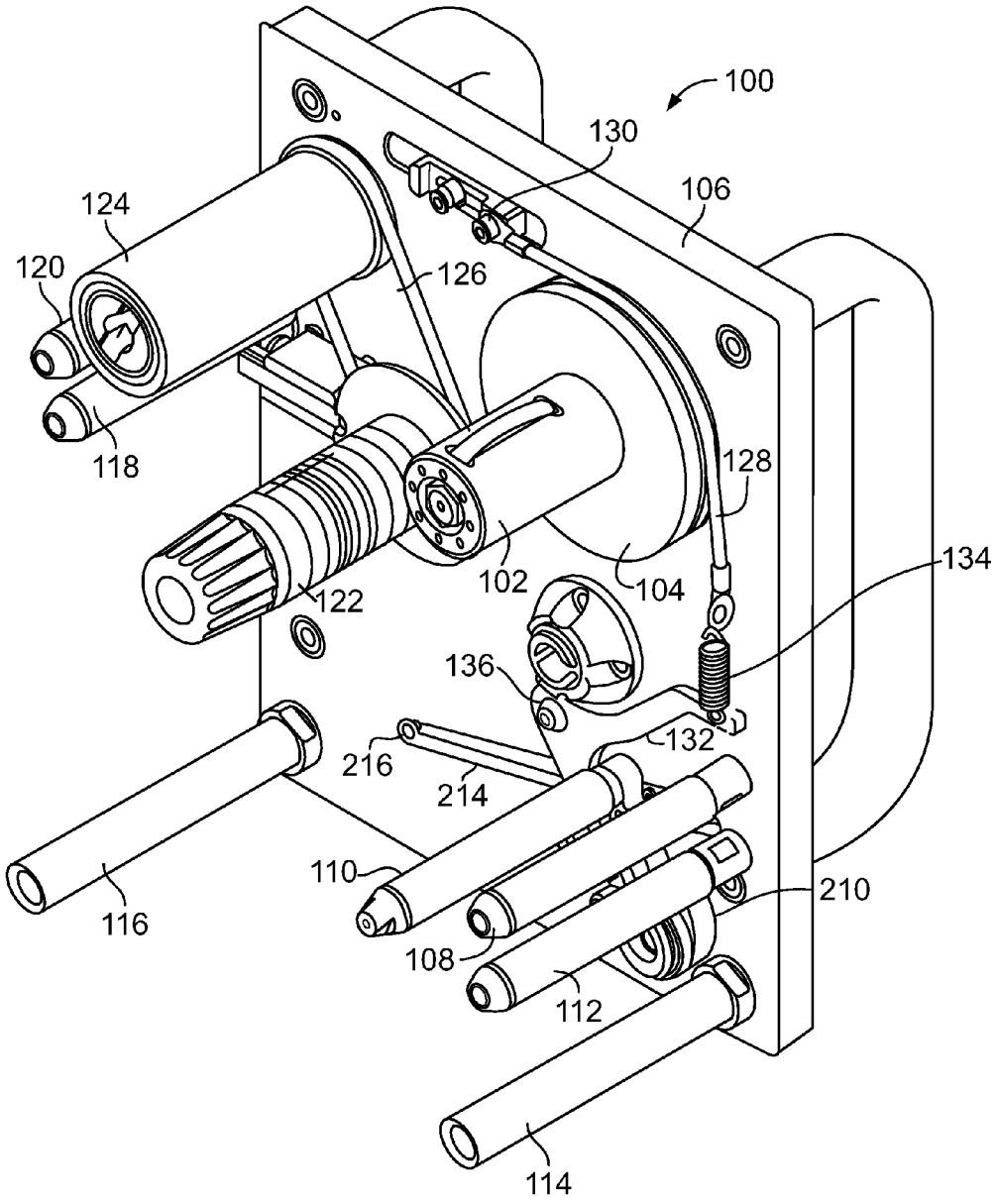
FIG. 3 illustrates a top view of the printing system shown in FIG. 1.
Figure 4:
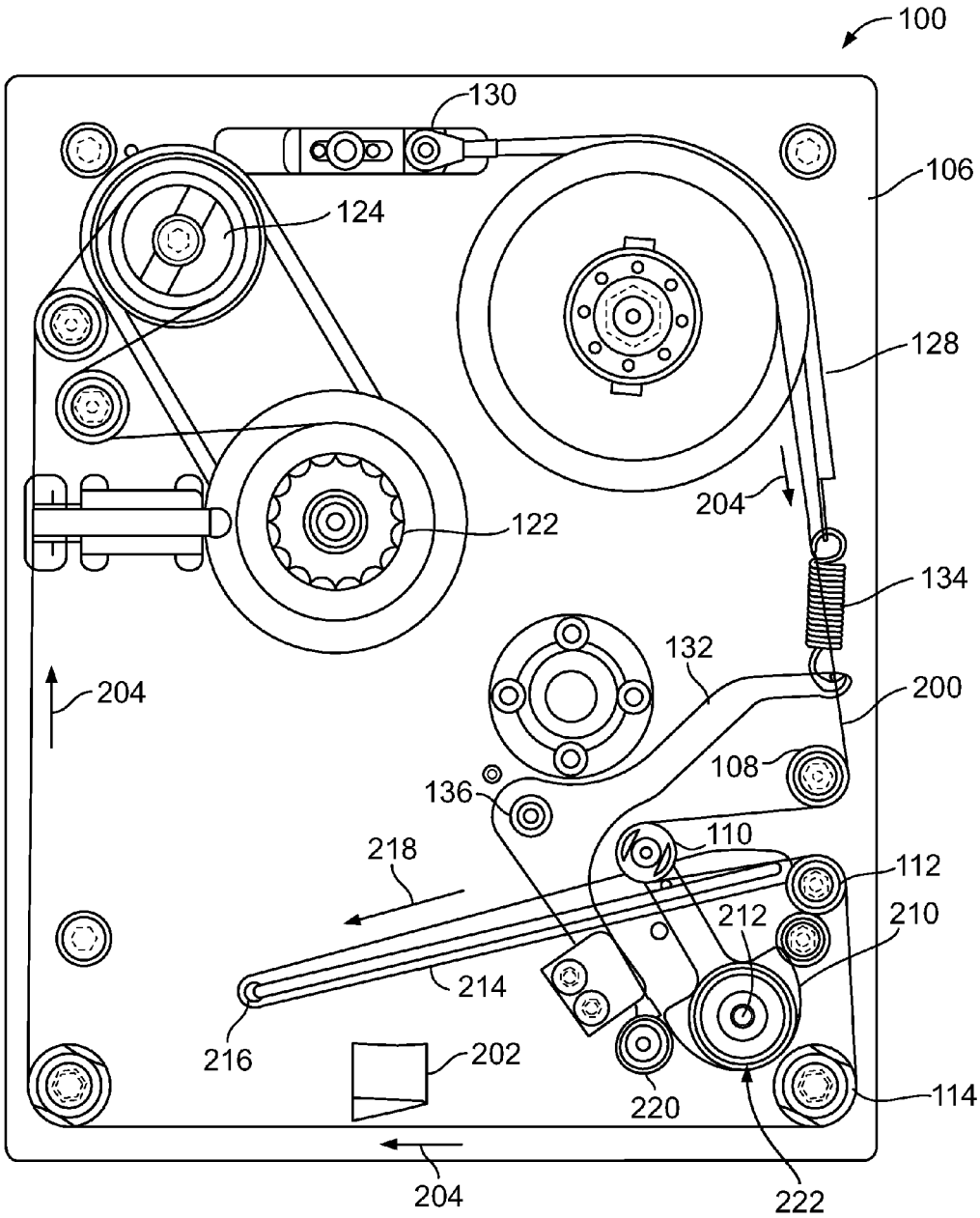
FIG. 4 illustrates another top view of the printing system shown in FIG. 1.

With continued reference to the printing system 100 shown in FIG. 1, FIG. 2 illustrates a top view of the printing system 100, FIG. 3 illustrates another perspective view of the printing system 100, and FIG. 4 illustrates another top view of the printing system 100. FIGS. 1 and 2 represent an embodiment of the printing system 100 where the printing system 100 is operating to decrease tension in the print ribbon 200 and/or decrease a braking force applied to the flange 104 of the unwind spindle 102. FIGS. 3 and 4 represent an embodiment of the printing system 100 where the printing system 100 is operating to increase tension in the print ribbon 200 and/or increase a braking force applied to the flange 104 of the unwind spindle 102. The printing system 100 may alternate between the state shown in FIGS. 1 and 2 and the state shown in FIGS. 3 and 4 to control tension in the ribbon 200. FIGS. 1 and 3 do not show the print ribbon 200, but FIGS. 2 and 4 illustrate the print ribbon 200 in the system 100.

FIGS. 2 and 4 show one example the path traversed by the print ribbon 200 as the print ribbon 200 is pulled from the unwind spindle 102 to the windup spindle 122. Other paths of the ribbon 200 may be used. Arrows 204 show the direction of travel of the ribbon 200. Additionally, the thermal print head 202 is shown in FIGS. 2 and 4.

The system 100 includes several components that control tension of the print ribbon 200 during the thermal transfer printing process. These components may collectively be referred to as a ribbon tension control system 140. Proper ribbon tension can be helpful to maintain good image quality and avoid breakage of the ribbon 200. As the ribbon 200 is pulled off of the unwind spindle 102, an outer diameter 206 of the ribbon 200 that is wound up on the unwind spindle 102 reduces. Although only a single winding of the ribbon 200 on the unwind spindle 102 is shown, the ribbon 200 may be wound onto the unwind spindle 102 many times onto itself. As the outer diameter of the wound up ribbon 200 reduces, the torque (or tension) experienced by the ribbon 200 as the windup spindle 124 continues to pull on the ribbon 200 changes, while the drag or braking force provided by the fixed disc remains substantially the same. When the outer diameter 206 of the ribbon 200 is relatively large (e.g., when a new winding of ribbon 200 is placed onto the unwind spindle 102 or when a relatively small amount of the ribbon 200 has been removed from the unwind spindle 102), the tension on the ribbon 200 is relatively low. Conversely, as the outer diameter 206 of the ribbon 200 decreases, the tension on the ribbon 200 may increase. Additionally, the windup spindle 122 may apply different torques to the ribbon 200 and/or sporadically or periodically apply torques to the ribbon 200. For example, the feed roller 124 may speed up and slow down in an intermittent or periodic manner such that the windup spindle 122 does not apply a constant torque on the ribbon 200. This manner of applying torque to the ribbon 200 changes the tension in the ribbon 200 over time.

The ribbon tension control system 140 includes several components that control the tension in the ribbon 200 such that changes in the outer diameter 206 of the ribbon 200 and/or changes in the torque applied to the ribbon 200 by the windup spindle 124 are accounted for and, as a result, the tension in the ribbon 200 is more constant and/or changes in this tension are reduced. In an embodiment, the system 140 controls tension in the ribbon 200 by use of a mechanical governor that compensates for increased torque applied by the windup spindle 124 by adjusting a brake force applied to the flange 104 of the unwind spindle 102.

In the illustrated embodiment, the roller 110 is referred to as a dancer roller 110 and is coupled with a cam lobe 210 of the system 140. The dancer roller 110 may rotate relative to the cam lobe 210 as the ribbon 200 passes around at least a portion of the dancer roller 110. The cam lobe 210 is pivotally mounted, such as to the support bracket 106 or to another component, so that the cam lobe 210 can pivot about (e.g., at least partially around) a pivot point 212. This pivoting motion allows the dancer roller 110 to move relative to the rollers 108, 112 when tension in the ribbon 200 changes. For example, the rollers 108, 112 may rotate as the ribbon 200 is moved along the rollers 108, 112, but may otherwise be fixed in position. The pivoting action of the cam lobe 210 allows the dancer roller 110 to laterally move along an arc defined by the pivot point 212 and the location of the dancer roller 110 on the cam lobe 210. By "laterally," it is meant that the dancer roller 110 moves relative to one or more of the spindles 102, 122 and/or the rollers 108, 112 along one or more curved, arced, and/or linear directions. The position of the dancer roller 110 may change relative to the locations of the rollers 108, 112 (and/or one or more other components) as the tension in the ribbon 200 changes.

When the tension on the ribbon 200 decreases or is relatively low, the cam lobe 210 may pivot in a rightward direction from the perspective of FIG. 2 such that the dancer roller 110 moves closer to the rollers 108, 112, as shown in FIGS. 1 and 2. A tension control member 214 (a resistive body such as a spring or other body that deforms but resists deformation by applying an opposing force) of the system 140 applies a force onto the cam lobe 210 and/or the dancer roller 110 to resist movement of the dancer roller 110 toward the rollers 108, 112. For example, a spring may be coupled with a fixed anchor location 216 and the cam lobe 210 such that the spring is extended when the dancer roller 110 moves toward the rollers 108, 112. The tension control member 214 applies a returning force onto the cam lobe 210 and/or the dancer roller 110 to pull the cam lobe 210 and/or dancer roller 110 in the direction of arrow 218, such as toward the position shown in FIGS. 3 and 4. As shown in FIG. 4, this force pulls the dancer roller 110 away from the rollers 108, 112. As a result, when the tension in the ribbon 200 decreases, the tension control member 214 can apply the returning force to counteract this movement. This returning force can ensure that the tension in the ribbon 200 does not decrease by too much and/or that the tension does not decrease too rapidly to cause problems with printing from the ribbon 200 onto a target object, such as what can occur when the ribbon 200 is traveling slower between the thermal print head 202 and the target object than a designated lower speed limit. In an embodiment, the returning force increases the tension in the ribbon 200.

The returning force applied by the tension control member 214 can be controlled such that the tension in the ribbon 200 is within predefined (e.g., previously designated) limits. For example, a spring having a designated spring constant (k) or a spring constant (k) within a designated range may be used as the tension control member 214. Such a spring may be selected so that a sufficiently large returning force is applied on the cam lobe 210 and/or dancer roller 110 to prevent the tension in the ribbon 200 from decreasing below a designated value and/or decreasing at more than a designated rate (e.g., of deceleration), but the returning force may be sufficiently small to prevent the tension in the ribbon 200 from increasing above another designated value and/or increasing at more than a designated rate (e.g., of acceleration).

In an embodiment, the ribbon tension control system 140 includes components to vary a braking force that is applied to the flange 104 of the unwind spindle 102. This braking force resists rotation of the flange 104 and the unwind spindle 102 in a direction that corresponds to the ribbon 200 being dispensed from the unwind spindle 102. The braking force may need to be altered as the diameter 206 of the ribbon 200 on the unwind spindle 102 changes and/or the torque applied to the ribbon 200 by the windup spindle 122 changes in order to maintain the tension in the ribbon 200 to within designated limits. Without varying this braking force, a decrease in the tension on the ribbon 200 (e.g., a relatively rapid deceleration of the ribbon 200) may cause the unwind spindle 102 to continue rotating at a relatively fast rate (e.g., at a faster speed than the windup spindle 122) and, as a result, too much slack may build up in the ribbon 200 between the spindles 102, 122 (e.g., the tension may decrease below a designated lower threshold). Conversely, without varying the braking force, an increase in the tension on the ribbon 200 (e.g., a relatively rapid acceleration of the ribbon 200) may cause the unwind spindle 102 to rotate too slowly and, as a result, the tension in the ribbon 200 may increase too much (e.g., above a designated upper threshold).

As shown in FIGS. 1-4, the tension in the ribbon 200 may be at least partially controlled or maintained by altering the path traversed by the ribbon 200. When the torque applied to the ribbon 200 increases, the dancer roller 110 may tend to move toward the position shown in FIGS. 1 and 2. This movement of the dancer roller 110 shortens the tortuous path followed by the ribbon 200 from the unwind spindle 102 to the windup spindle 122 in order to decrease tension in the ribbon 200. Conversely, when the torque applied to the ribbon 200 decreases, the dancer roller 110 may tend to move toward the position shown in FIGS. 3 and 4. This movement of the dancer roller 110 lengthens the tortuous path followed by the ribbon 200 from the unwind spindle 102 to the windup spindle 122 in order to increase tension in the ribbon 200.

In order to control the braking force, the system 140 includes a brake 128 positioned to engage the flange 104 of the unwind spindle 102 while tension on the brake 128 is increased or decreased to respectively increase or decrease the braking force. The brake 128 is shown as an elongated strap that engages an outer diameter of the flange 104, but may be provided in another form, such as a brake pad or other body. Optionally, the brake 128 may engage another part of the flange 104, and/or may engage the unwind spindle 102, to apply the braking force.

The brake 128 is anchored to the support bracket 106 at an anchor location 130 and is coupled with a brake actuating arm 132 of the system 140. In the illustrated embodiment, one end of the brake 128 is coupled with the support bracket 106 at the anchor location 130 and the opposite end of the brake 128 is coupled with a resilient member 134 (such as a spring), which is coupled with the actuating arm 132. Additionally or alternatively, this end of the brake 128 may be directly coupled with the actuating arm 132. The resilient member 134 may be used to absorb abrupt changes in the braking force and/or tension in the ribbon 200 so that increases or decreases in the braking force and/or tension do not occur too quickly.

The actuating arm 132 is pivotally mounted at a pivot point or location 136 so that the actuating arm 132 may at least partially pivot about (e.g., around) the pivot point 136. One end of the actuating arm 132 is coupled with the brake 128 as described above, and another end of the actuating arm 132 includes a rolling mechanism 220 (shown in FIGS. 2 and 4) at one end that engages the cam lobe 210, such as a bearing, a roller, or other component capable of rolling along the cam lobe 210. Alternatively, the actuating arm 132 may not include any rolling mechanism that engages the cam lobe 210. The pivot location 136 is disposed between these ends of the actuating arm 132.

In the illustrated embodiment, the cam lobe 210 has a rounded end 222 (shown in FIGS. 2 and 4) that engages the rolling mechanism 138 of the actuating arm 132. As the cam lobe 210 pivots about the pivot point 212, as described above, the rolling mechanism 220 of the actuating arm 132 moves (e.g., rolls) along the rounded end 222 of the cam lobe 210. This movement of the rolling mechanism 220 along the rounded end 222 of the cam lobe 210 causes the actuating arm 132 to pivot about the pivot point 136.

When the dancer roller 110 moves in a direction generally oriented from the position of the dancer roller 110 in FIG. 2 to the position of the dancer roller 110 in FIG. 4, the rolling mechanism 220 moves along the rounded end 222 of the cam lobe 210 in a first direction. This movement causes the articulating arm 132 to pivot in a clockwise direction. For example, when the resistive member 214 pulls on the cam lobe 210 and/or dancer roller 110 to increase tension in the ribbon 200, the articulating arm 132 pivots in a clockwise direction. This movement of the articulating arm 132 causes the brake 128 to be pulled against the flange 104 of the unwind spindle 102, thereby increasing the braking force applied to the flange 104 by the brake 128.

The increased braking force can assist in preventing the ribbon 200 from being pulled from the unwind spindle 102 too quickly as the resistive member 214 pulls on the cam lobe 210 and/or dancer roller 110 to increase the tension in the ribbon 200. For example, increasing the tension in the ribbon 200 too quickly can cause the unwind spindle 102 to rotate too quickly (e.g., faster than the windup spindle 122) and to deliver too much ribbon 200 into the rollers 108, 110, 112, which can result in slack being built up in the ribbon 200. The increase in braking force helps to balance the increase in ribbon tension such that the tension is increased without the unwind spindle 102 rotating too quickly.

In contrast, when the dancer roller 110 moves in a generally opposite direction (e.g., in a direction of the position of the dancer roller 110 in FIG. 4 to the position of the dancer roller 110 in FIG. 2), the rolling mechanism 220 moves along the rounded end 222 of the cam lobe 210 in a second opposite direction (to the direction of movement of the rolling mechanism 220 described above) with a resilient member 134 sized such that the rolling mechanism 220 is held in contact with the cam lobe 210. This movement causes the articulating arm 132 to pivot in a counter-clockwise direction. For example, when the dancer roller 110 moves toward the rollers 108, 112 in response to an increase of tension in the ribbon 200, the articulating arm 132 pivots in a counter-clockwise direction.

This movement of the articulating arm 132 causes the pulling on the brake 128 by the articulating arm 132 to be decreased, thereby decreasing the braking force applied to the flange 104 by the brake 128. If the ribbon breaks, the resistive member 214 can cause the dancer roller 110 to move counter-clockwise and trigger a "ribbon break" sensor. For example, the counter-clockwise movement of the dancer roller 110 may be detected by a sensor (e.g., optically detected or detected in another manner). This detection may be reported to an operator as an indication that the ribbon has broken.

The increased braking force can assist in preventing the ribbon 200 from being pulled from the unwind spindle 102 too quickly as the resistive member 214 pulls on the cam lobe 210 and/or dancer roller 110 to increase the tension in the ribbon 200. For example, increasing the tension in the ribbon 200 relatively fast can cause the unwind spindle 102 to rotate too quickly (e.g., faster than the windup spindle 122) and to deliver too much ribbon 200 into the rollers 108, 110, 112, which can result in slack being built up in the ribbon 200. The increase in braking force helps to balance the increase in ribbon tension such that the tension is increased without the unwind spindle 102 rotating too quickly. For example, the increased braking force can reduce or limit how quickly the flange 104 and the unwind spindle 102 rotate to supply ribbon 200 into the printing system 100.

The amount of change in the braking force that is applied by the brake 128 and the articulating arm 132 can vary responsive to changes in the tension in the ribbon 200. For example, instead of changing the braking force in discrete amounts, the braking force may change in non-discrete amounts (e.g., along or among a continuous or substantially continuous spectrum of braking forces) in proportion to the changes in the ribbon tension.

As described herein, the tension in the print ribbon 200 can be controlled to be maintained within designated limits responsive to changes in the torque applied to the ribbon 200 by the windup spindle 122. In an embodiment, no sensors or other components are used to sense or detect a measured amount of tension in the print ribbon 200. Instead, the components described herein cooperate together to vary the tension in the print ribbon 200 and the braking force applied to the unwind spindle 102 in response to changes in the torque from the windup spindle 122, without measuring or quantitatively sensing the ribbon tension.

The cam lobe 210, the dancer roller 110, and the tension control member 214 may be referred to as a ribbon tension control apparatus of the tension control system 140 and the articulating arm 132 and the brake 128 may be referred to as a brake apparatus of the tension control system 140. As described above, such a ribbon tension control apparatus controls tension in the ribbon 200 by moving the dancer roller 110 and cam lobe 210 in response to changes to the torque applied to the ribbon 200. Also as described above, such a brake apparatus controls tension in the ribbon 200 by altering the brake force applied to the unwind spindle 102 and/or flange 104.

Figure 5:
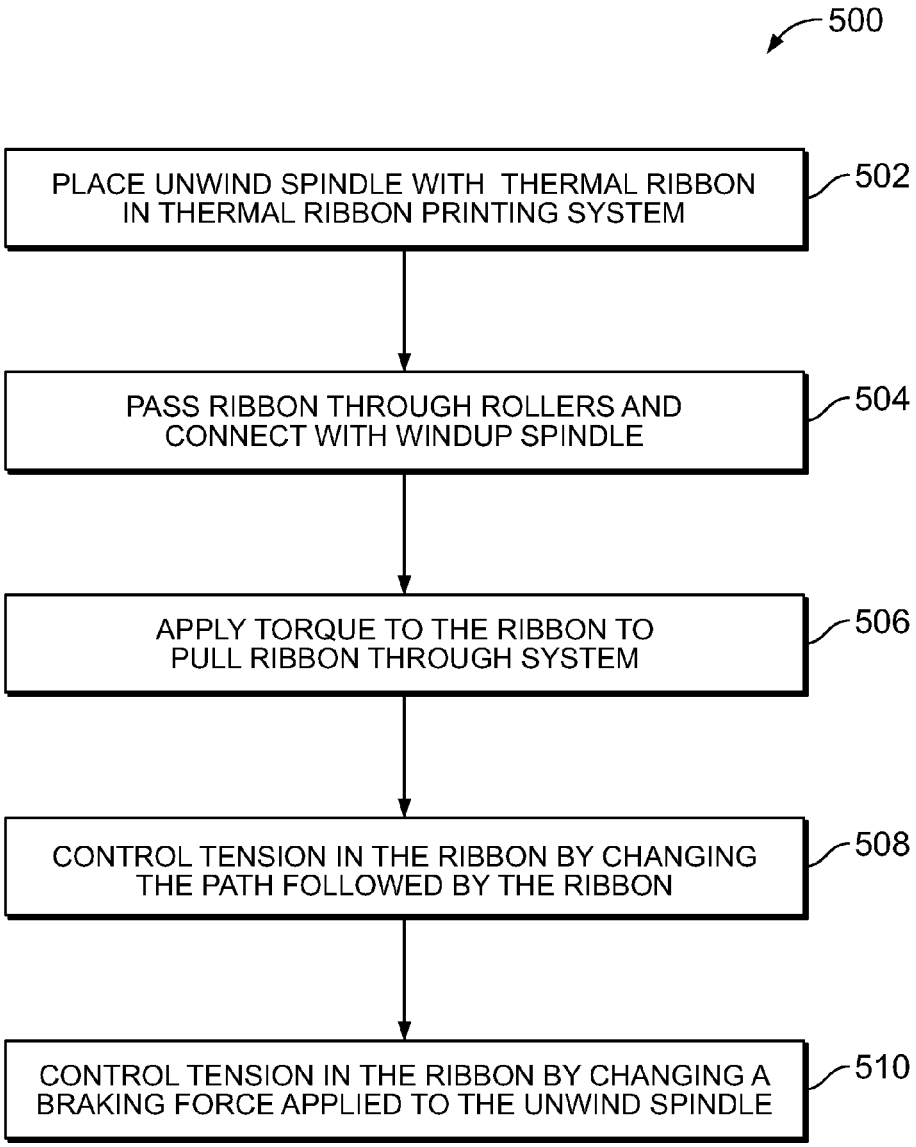
FIG. 5 is a flowchart of one example of a method for controlling tension in a print ribbon in a thermal ribbon printing system.

FIG. 5 is a flowchart of one example of a method 500 for controlling tension in a print ribbon in a thermal ribbon printing system. The method 500 may be practiced by the ribbon tension control system 140 in the thermal ribbon printing system 100.

At 502, an unwind spindle having thermal print ribbon wound up thereon is placed into the thermal ribbon printing system. For example, the unwind spindle 102 may be mounted in the system 100 with the ribbon 200 wound up thereon. At 504, the ribbon 200 is passed around one or more rollers, such as the roller 110 and one or more of the rollers 108, 112, 114, 116, 118, 120. The ribbon 200 is at least partially wound around the dancer roller 110 such that the dancer roller 110 can laterally move relative to the unwind spindle 102 to change tension in the ribbon 200, as described above. The ribbon 200 is positioned within the system 100 such that the ribbon 200 extends between the thermal print head 202 and a location where objects to be printed upon are to be placed. The ribbon 200 also is connected to the windup spindle 122.

At 506, torque is applied to the ribbon 200 to pull the ribbon 200 through the printing system 100 and between the print head 202 and target objects. The windup spindle 122 may be rotated by a motor, such as the feed roller 124, to apply this torque. The windup spindle or feed roller 122 may apply the torque in an intermittent or non-continuous basis, which can involve increasing and decreasing the torque over time as target objects are positioned to be printed upon, printed upon, and removed. The thermal print head 202 applies heat and pressure to the ribbon 200 as the windup spindle 122 pulls the ribbon 200 between the print head 202 and a target object.

At 508, as the windup spindle 122 applies torque to the ribbon 200 and/or changes the torque applied to the ribbon 200, the tension in the ribbon 200 is controlled by changing the path followed by the ribbon 200 in the printing system 100. The path followed by the ribbon 200 in the printing system 100 may be altered by moving one or more rollers around which the ribbon 200 at least partially passes and/or by applying a resistive force to the one or more rollers. For example, the dancer roller 110 can laterally move in response to changing torque in the ribbon 200 and the tension control member 214 applies a force to the dancer roller 110 to maintain the ribbon tension and/or to reduce changes in the ribbon tension. If the torque applied to the ribbon 200 would otherwise cause the ribbon tension to increase (e.g., without the presence of the tension control system 140), the dancer roller 110 may tend to move toward the position of the dancer roller 110 shown in FIGS. 1 and 2 (and shorten the path traversed by the ribbon 200 through the printing system 100). The tension control member 214 acts to pull the dancer roller 110 generally toward the position of the dancer roller 110 shown in FIGS. 3 and 4. The tension in the ribbon 200 and the force applied by the tension control member 214 may balance each other out so that the ribbon tension is within a designated range.

If the torque applied to the ribbon 200 would otherwise cause the ribbon tension to decrease (e.g., without the presence of the tension control system 140), the dancer roller 110 may tend to move toward the position of the dancer roller 110 shown in FIGS. 3 and 4. The tension control member 214 pulls the dancer roller 110 generally toward the position of the dancer roller 110 shown in FIGS. 3 and 4 to increase the tension in the ribbon 200 (and lengthen the path traversed by the ribbon 200 through the printing system 100). Once the windup spindle 122 increases the torque applied to the ribbon 200, the tension in the ribbon increases. The tension in the ribbon 200 and the force applied by the tension control member 214 may balance each other out so that the ribbon tension is within a designated range.

At 510, as the windup spindle 122 applies torque to the ribbon 200 and/or changes the torque applied to the ribbon 200, the braking force applied to the unwind spindle 102 and/or the flange 104 is controlled to maintain the ribbon tension. For example, the force needed to overcome the braking force and pull the ribbon 200 off the unwind spindle 102 may change in order to maintain the ribbon tension. In an embodiment, the braking force can be controlled by pulling the brake 128 against the flange 104 (or another component coupled with the unwind spindle 102) to increase the braking force and thereby increase tension in the ribbon 200. The braking force also or alternatively may be controlled by decreasing the pulling force on the brake 128 against the flange 104 (or another component coupled with the unwind spindle 102) to decrease the braking force and thereby decrease tension in the ribbon 200.

As the dancer roller 110 laterally moves in response to changing torque in the ribbon 200, the articulating arm 132 engages the cam lobe 210 and moves along the cam lobe 210 in such a way that the articulating arm 132 pivots in a clockwise or counter-clockwise direction. Pivoting of the articulating arm 132 in one direction causes the braking force to be increased and pivoting of the articulating arm 132 in another direction causes the braking force to be decreased, as described above. The articulating arm 132 varies the braking force responsive to the movement of the dancer roller 110, which moves responsive to changes in the torque applied to the ribbon 200.

The operations described in connection with 506, 508, and/or 508 may occur simultaneously or concurrently. The method 500 may continue through one or more repetitions (e.g., loops of 506, 508, 510) until printing from the ribbon 200 is complete and/or the printing system 100 is deactivated.

In one embodiment, a ribbon tension control system for a printing system includes a ribbon tension control apparatus. The ribbon tension control apparatus is configured to engage a print ribbon that extends through the printing system for applying one or more inks. The print ribbon may be in the form of a tape, such as a thin strip of mylar with a coating of dried ink on one side and a slip agent (e.g., a low friction substance) on the other. The slip agent can assist in reducing wear on the print head of the printing system. The ink in the print ribbon is applied to one or more target objects as the print ribbon is pulled from an unwind spindle to a windup spindle in the printing system. The ribbon tension control apparatus also is configured to control tension in the ribbon in response to change in a torque applied to the windup spindle that is used to pull the ribbon through the printing system.

In one aspect, the print ribbon is wound around the unwind spindle to an outer diameter. The ribbon tension control apparatus is configured to maintain the tension in the ribbon between an upper designated limit and a lower designated limit as the ribbon is pulled from the unwind spindle and the outer diameter of the ribbon that is wound on the unwind spindle decreases.

In one aspect, the ribbon tension control system also includes a brake apparatus configured to engage the ribbon tension control apparatus in the printing system. The brake apparatus is configured to control a braking force applied to the unwind spindle in response to the ribbon tension control apparatus controlling the tension in the ribbon.

In one aspect, the ribbon tension control apparatus includes a cam lobe pivotally mounted in the printing system that is configured to pivot responsive to changes in the torque applied by the windup spindle. The braking apparatus includes a brake engaged with at least one of the unwind spindle or a flange coupled with the unwind spindle and an articulating arm pivotally mounted in the printing system and coupled with the brake. The articulating arm is configured to engage the cam lobe and to move along the cam lobe as the cam lobe pivots responsive to changes in the torque applied by the windup spindle. The articulating arm pulls on the brake when the articulating arm moves along the cam lobe in a first direction to increase a braking force applied on the at least one of the unwind spindle or the flange.

In one aspect, the articulating arm is configured to reduce a pulling force exerted on the brake by the articulating arm when the articulating arm moves along the cam lobe in an opposite, second direction to decrease the braking force applied on the at least one of the unwind spindle or the flange.

In one aspect, the ribbon tension control apparatus is configured to control the tension in the ribbon by lengthening a path followed by the ribbon through the printing system to increase the tension.

In one aspect, the ribbon tension control apparatus is configured to control the tension in the ribbon by shortening a path followed by the ribbon through the printing system to decrease the tension.

In one aspect, the ribbon tension control apparatus includes a cam lobe pivotally mounted in the printing system, a dancer roller coupled with the cam lobe and around which the ribbon at least partially wraps as the ribbon extends through the printing system, and a resistive tension control member coupled with at least one of the cam lobe or the dancer roller and anchored in the printing system to provide a resistive force to the at least one of the cam lobe or the dancer roller. The cam lobe is configured to pivot to permit the dancer roller to move within the printing system responsive to the torque applied by the windup spindle changing and the tension control member is configured to apply the resistive force to the at least one of the cam lobe or the dancer roller to counteract the dancer roller moving within the printing system to control the tension in the ribbon.

In one embodiment, a method for controlling tension in a print ribbon of a printing system includes winding the print ribbon from an unwind spindle to a windup spindle. The print ribbon at least partially passes through a ribbon tension control apparatus. The method also includes pulling the print ribbon through the printing system from the unwind spindle to the windup spindle by applying a torque from the windup spindle. The print ribbon is pulled between a print head and one or more target objects to be printed upon by ink in the print ribbon when the print head engages the print ribbon. The method further includes controlling the tension in the print ribbon as the torque applied by the windup spindle changes by at least one of changing a path that the print ribbon follows through the printing system or varying a braking force applied to the unwind spindle.

In one aspect, the print ribbon is wound around the unwind spindle to an outer diameter and pulling the print ribbon from the unwind spindle decreases the outer diameter of the print ribbon on the unwind spindle. Controlling the tension in the print ribbon includes maintaining the tension in the ribbon between an upper designated limit and a lower designated limit as the outer diameter of the ribbon decreases.

In one aspect, controlling the tension in the print ribbon includes varying the braking force applied to the unwind spindle in response to changing the path that the print ribbon follows through the printing system.

In one aspect, controlling the tension in the print ribbon includes moving an articulating arm that is pivotally mounted in the printing system and coupled with a brake that applies the braking force along a cam lobe that pivots responsive to changes in the torque applied by the windup spindle. The articulating arm pulls on the brake when the articulating arm moves along the cam lobe in a first direction to increase the braking force.

In one aspect, controlling the tension in the print ribbon includes reducing a pulling force exerted on the brake by the articulating arm when the articulating arm moves along the cam lobe in an opposite, second direction to decrease the braking force.

In one aspect, controlling the tension in the print ribbon includes lengthening a path followed by the ribbon through the printing system to increase the tension.

In one aspect, controlling the tension in the print ribbon includes shortening a path followed by the ribbon through the printing system to decrease the tension.

In one embodiment, a tension control system of a thermal ribbon printing system includes a cam lobe, a dancer roller, a tension control member, an articulating arm, and a brake. The cam lobe is pivotally mounted in the thermal ribbon printing system. The dancer roller is coupled with the cam lobe. The tension control member is anchored in the thermal ribbon printing system and is coupled with at least one of the cam lobe or the dancer roller. The articulating arm is pivotally mounted in the thermal ribbon printing system and engages the cam lobe. The brake is coupled with the articulating arm and is configured to engage at least one of an unwind spindle or a flange coupled to the unwind spindle of the thermal ribbon printing system to apply a braking force to the unwind spindle. A thermal print ribbon extends from the unwind spindle, at least partially around the dancer roller, between a thermal print head and one or more target objects to be printed upon by the ribbon, and to a windup spindle. When the windup spindle applies a time-varying force to pull the ribbon through the thermal ribbon printing system, the cam lobe pivots to permit the dancer roller to laterally move in the thermal ribbon printing system and the tension control member applies an opposing force to resist the dancer roller laterally moving. Pivoting of the cam lobe causes the articulating arm to pivot, which changes a pulling force applied to the brake in order to vary the braking force.

In one aspect, the opposing force applied by the tension control member and the braking force maintain a tension in the print ribbon within previously designated limits as the print ribbon is pulled through the thermal ribbon printing system.

In one aspect, the print ribbon is wound onto the unwind spindle to an outer diameter that is decreased as the print ribbon is pulled off of the unwind spindle and through the thermal ribbon printing system. The opposing force applied by the tension control member and the braking force maintain a tension in the print ribbon within previously designated limits as the outer diameter decreases.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A ribbon tension control system for a printing system, the ribbon tension control system comprising:

a ribbon tension control apparatus configured to engage a print ribbon that extends through the printing system for applying one or more inks in the print ribbon to one or more target objects as the print ribbon is pulled from an unwind spindle to a windup spindle in the printing system, the ribbon tension control apparatus configured to control tension in the ribbon in response to change in a torque applied to the windup spindle that is used to pull the ribbon through the printing system; and a brake apparatus configured to engage the ribbon tension control apparatus in the printing system, the brake apparatus configured to control a braking force applied to the unwind spindle in response to the ribbon tension control apparatus controlling the tension in the ribbon, wherein the ribbon tension control apparatus includes a cam lobe pivotally mounted in the printing system that is configured to pivot responsive to changes in the torque applied by the windup spindle, and the braking apparatus includes:

a brake engaged with at least one of the unwind spindle or a flange coupled with the unwind spindle; and an articulating arm pivotally mounted in the printing system and coupled with the brake, the articulating arm configured to engage the cam lobe and to move along the cam lobe as the cam lobe pivots responsive to changes in the torque applied by the windup spindle, the articulating arm pulling on the brake when the articulating arm moves along the cam lobe in a first direction to increase a braking force applied on the at least one of the unwind spindle or the flange.

2. The ribbon tension control system of claim 1, wherein the print ribbon is wound around the unwind spindle to an outer diameter, and the ribbon tension control apparatus is configured to maintain the tension in the ribbon between an upper designated limit and a lower designated limit as the ribbon is pulled from the unwind spindle and the outer diameter of the ribbon that is wound on the unwind spindle decreases.

3. The ribbon tension control system of claim 1, wherein the articulating arm is configured to reduce a pulling force exerted on the brake by the articulating arm when the articulating arm moves along the cam lobe in an opposite, second direction to decrease the braking force applied on the at least one of the unwind spindle or the flange.

4. The ribbon tension control system of claim 1, wherein the ribbon tension control apparatus is configured to control the tension in the ribbon by lengthening a path followed by the ribbon through the printing system to increase the tension.

5. The ribbon tension control system of claim 1, wherein the ribbon tension control apparatus is configured to control the tension in the ribbon by shortening a path followed by the ribbon through the printing system to decrease the tension.

6. The ribbon tension control system of claim 1, wherein the ribbon tension control apparatus includes:

a cam lobe pivotally mounted in the printing system;

a dancer roller coupled with the cam lobe and around which the ribbon at least partially wraps as the ribbon extends through the printing system; and a resistive tension control member coupled with at least one of the cam lobe or the dancer roller, and anchored in the printing system to provide a resistive force to the at least one of the cam lobe or the dancer roller, wherein the cam lobe is configured to pivot to permit the dancer roller to move within the printing system responsive to the torque applied by the windup spindle changing and the tension control member is configured to apply the resistive force to the at least one of the cam lobe or the dancer roller to counteract the dancer roller moving within the printing system to control the tension in the ribbon.

7. A method for controlling tension in a print ribbon of a printing system, the method comprising:

winding the print ribbon from an unwind spindle to a windup spindle, the print ribbon at least partially passing through a ribbon tension control apparatus, pulling the print ribbon through the printing system from the unwind spindle to the windup spindle by applying a torque from the windup spindle, the print ribbon pulled between a print head and one or more target objects to be printed upon by ink in the print ribbon when the print head engages the print ribbon; and controlling the tension in the print ribbon as the torque applied by the windup spindle changes by at least one of changing a path that the print ribbon follows through the printing system or varying a braking force applied to the unwind spindle, wherein controlling the tension in the print ribbon includes varying the braking force applied to the unwind spindle in response to changing the path that the print ribbon follows through the printing system, and wherein controlling the tension in the print ribbon includes moving an articulating arm that is pivotally mounted in the printing system and coupled with a brake that applies the braking force along a cam lobe that pivots responsive to changes in the torque applied by the windup spindle, the articulating arm pulling on the brake when the articulating arm moves along the cam lobe in a first direction to increase the braking force.

8. The method of claim 7, wherein the print ribbon is wound around the unwind spindle to an outer diameter and pulling the print ribbon from the unwind spindle decreases the outer diameter of the print ribbon on the unwind spindle, and wherein controlling the tension in the print ribbon includes maintaining the tension in the ribbon between an upper designated limit and a lower designated limit as the outer diameter of the ribbon decreases.

9. The method of claim 7, wherein controlling the tension in the print ribbon includes reducing a pulling force exerted on the brake by the articulating arm when the articulating arm moves along the cam lobe in an opposite, second direction to decrease the braking force.

10. The method of claim 7, wherein controlling the tension in the print ribbon includes lengthening a path followed by the ribbon through the printing system to increase the tension.

11. The method of claim 7, wherein controlling the tension in the print ribbon includes shortening a path followed by the ribbon through the printing system to decrease the tension.

12. A tension control system of a thermal ribbon printing system, the tension control system comprising:

a cam lobe pivotally mounted in the thermal ribbon printing system;

a dancer roller coupled with the cam lobe;

a tension control member anchored in the thermal ribbon printing system and coupled with at least one of the cam lobe or the dancer roller;

an articulating arm pivotally mounted in the thermal ribbon printing system, the articulating arm engaging the cam lobe; and a brake coupled with the articulating arm and configured to engage at least one of an unwind spindle or a flange coupled to the unwind spindle of the thermal ribbon printing system to apply a braking force to the unwind spindle, wherein a thermal print ribbon extends from the unwind spindle, at least partially around the dancer roller, between a thermal print head and one or more target objects to be printed upon by the ribbon, and to a windup spindle, and wherein, when the windup spindle applies a time-varying force to pull the ribbon through the thermal ribbon printing system, the cam lobe pivots to permit the dancer roller to laterally move in the thermal ribbon printing system and the tension control member applies an opposing force to resist the dancer roller laterally moving, and wherein pivoting of the cam lobe causes the articulating arm to pivot, which changes a pulling force applied to the brake in order to vary the braking force.

13. The tension control system of claim 12, wherein the opposing force applied by the tension control member and the braking force maintain a tension in the print ribbon within previously designated limits as the print ribbon is pulled through the thermal ribbon printing system.

14. The tension control system of claim 12, wherein the print ribbon is wound onto the unwind spindle to an outer diameter that is decreased as the print ribbon is pulled off of the unwind spindle and through the thermal ribbon printing system, and wherein the opposing force applied by the tension control member and the braking force maintain a tension in the print ribbon within previously designated limits as the outer diameter decreases.

* * * * *